United States Patent [19]

Leo

[11] Patent Number: 4,757,926

[45] Date of Patent: Jul. 19, 1988

[54] DECORATIVE SLEEVE FOR WRIST WATCHBAND

[76] Inventor: Stephen Leo, 89 N. Broadway, White Plains, N.Y. 10603

[21] Appl. No.: 49,841

[22] Filed: May 15, 1987

[51] Int. Cl.[4] ..... A45C 11/10

[52] U.S. Cl. ..... 224/178; 224/173; 224/219; 224/175; 63/21; 24/265 WS; 368/282; 368/285

[58] Field of Search ..... 368/282, 285, 286, 283, 368/281; 224/164, 167, 168, 169, 170, 171–175, 176, 177, 178, 179, 180, 219, 267; D10/30, 31, 32, 33, 34, 35, 36, 38, 39; 2/DIG. 11, 161 A, 168, 170, 59, 91, 92; 24/265 WS; 63/3–7, 21

[56] References Cited

U.S. PATENT DOCUMENTS

| | | | |
|---|---|---|---|
| 2,150,069 | 3/1939 | Koleno | 2/59 |
| 2,602,573 | 7/1952 | Herbst | 224/168 |
| 2,649,230 | 8/1953 | Thompson | 368/282 X |
| 2,998,695 | 9/1961 | Cornett | 368/282 |
| 3,369,722 | 2/1968 | Hetterich | 224/173 |
| 3,837,007 | 9/1974 | Girest | 2/59 X |
| 4,103,808 | 8/1978 | Hallman et al. | 224/168 |

FOREIGN PATENT DOCUMENTS

| | | | |
|---|---|---|---|
| 458916 | 3/1928 | Fed. Rep. of Germany | 224/170 |

*Primary Examiner*—Henry J. Recla
*Assistant Examiner*—Ernest G. Cusick
*Attorney, Agent, or Firm*—Charles E. Temko

[57] ABSTRACT

A decorative sleeve for wrist watchbands is disclosed. The sleeve includes first and second elongated tubular elements, first ends of each of which are interconnected by a short segment of planar elastic material. The sleeve is positioned upon a watch such that substantial portions of each of two watchband segments or straps are enclosed within the tubular elements, with the elastic segment being disposed beneath the rear surface of the watch case.

3 Claims, 1 Drawing Sheet

DECORATIVE SLEEVE FOR WRIST WATCHBAND

BACKGROUND OF THE INVENTION

This invention relates generally to the field of costume jewelry and similar adornment, and more particularly to a decorative article which may be changed as desired to be substituted by other similar articles to provide a unique decorative appearance to an otherwise conventional wrist watch.

It is known in the art to provide a watch case having a set of removable bracelets, each embellished with a diversity of fancy designs to suit the occasion for which it is worn, the watch itself not being provided with any fixed form of decoration. Structures of this type are disclosed, for example in U.S. Pat. No. 2,624,981 granted Mar. 3, 1953 to Melik-Minassiantz.

Such structures, while effective, are quite costly to manufacture, and cannot utilize the availability of multitudinous designs available in the form of textile fabrics which may match or complement the fabrics of a garment.

For non-decorative purposes, it is also known to provide a pair of sleeves adapted to enclose the strap portions of a watchband interconnected by a centrally positioned planar cover adapted to enclose the case of a watch. An example of such structure is disclosed in U.S. Pat. No. 2,998,695 granted Sept. 5, 1961 to Cornett. Such devices are also relatively expensive to manufacture, and offer no decorative function.

SUMMARY OF THE INVENTION

Briefly stated, the invention contemplates the provision of an improved device of the class described particularly adapted to provide a decorative function in enclosing the two strap segments of a conventional watchband. The device is formed of textile materials, woven or preferably knitted, as a pair of elongated tubular members interconnected by a short length of planar elastic material which, upon installation, underlies the rear surface of a watch case. It can be readily removed for substitution of a like device having a different ornamental motif.

BRIEF DESCRIPTION OF THE DRAWING

In the drawing, to which reference will be made in the specification, similar reference characters have been employed to designate corresponding parts throughout the several views.

DESCRIPTION OF THE PREFERRED EMBODIMENT

Figure 2:
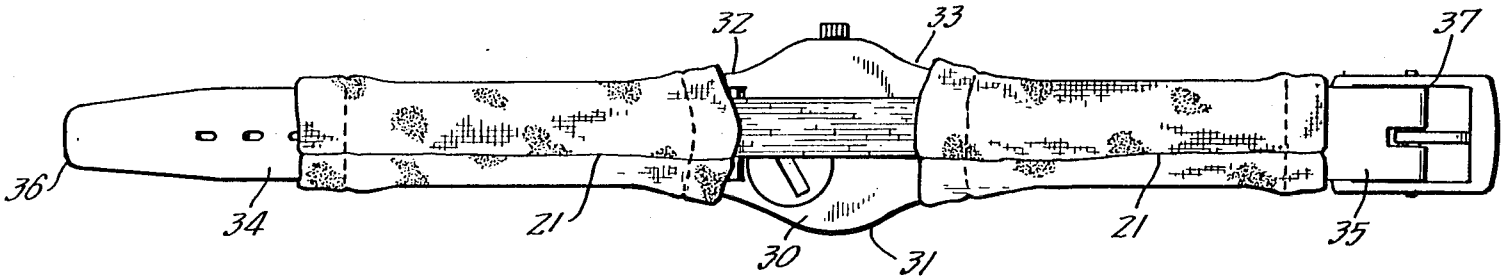
FIG. 2 is a view in elevation showing the embodiment in installed condition upon a conventional wrist watch.
Figure 1:
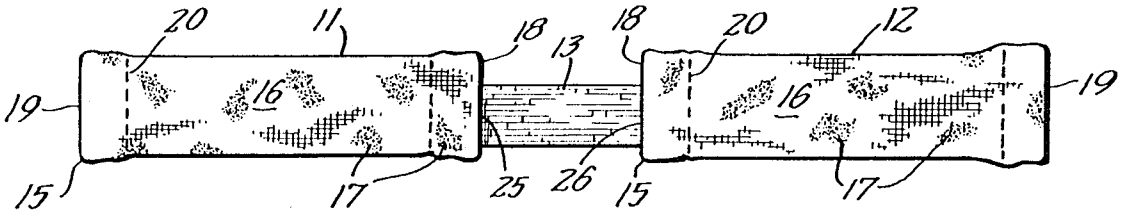
FIG. 1 is a view in perspective of an embodiment of the invention.

In accordance with the invention, the device, generally indicated by reference character 10, comprises broadly: first and second elongated tubular members 11 and 12, respectively, and a planar elastic interconnecting member 13.

The tubular members 11 and 12 are substantially similar, each including an elongated textile web of material 15 having an outer surface 16 bearing a decorative pattern 17, and bounded by first and second end edges 18 and 19, respectively. Each end edge is provided with a stitched hem 20 to prevent unraveling, and a longitudinally extending seam 21 between the first and second end edges, as seen in FIG. 2.

The elastic member 13 is of a conventional type often used to constrict portions of a garment upon a wearer, and most suitably is approximately one-half inch in width and one inch in length, terminating in first and second ends 25 and 26, respectively. These ends are stitched or otherwise interconnected to the first end edges 18 of each of the tubular members 11 and 12.

FIG. 2 illustrates installation of the device 10 upon a conventional wrist watch 30 having a case element 31 having first and second end portions 32 and 33 interconnecting first and second strap members 34 and 35. The members 34 and 35 each have interconnectible ends 36 and 37, normally in the form of a buckle. Installation is performed by inserting the free ends of the strap members into the openings provided by the first ends of each of the tubular members, it being necessary to slightly stretch that tubular member which engages the strap member having the buckle. By positioning the elastic member to overlie the inner surface of the case, the longitudinal seams 21 will be concealed from view when the watch is worn. The device may be removed to be substituted by another similar device (not shown) having a different decorative pattern by merely reversing the above-described operation.

Given the materials from which the device 10 is manufactured, the total cost of manufacture may be of a relatively low order, permitting a typical watch owner to own many such devices, each featuring a different decorative design. Since the device is made of textile material, it may be conveniently washed or laundered as required.

I wish it to be understood that I do not consider the invention to be limited to the percise details of structure shown and set forth in this specification, for obvious modifications will occur to those skilled in the art to which the invention pertains.

I claim:

1. In combination, a wrist watch including a watch case and a pair of interconnectable strap members, and a decorative sleeve therefor, said sleeve comprising first and second elongated tubular members of a textile material having a decorative pattern on an outer surface, each of said tubular members having first and second ends; an elongated elastic member of planar configuration, said elastic member interconnecting said first ends of said tubular members, said sleeve being selectively engaged upon said strap members such that each of said tubular members encloses a single strap member, with said elastic member being thereby disposed to overlie a planar surface of said case.

2. The combination in accordance with claim 1, further characterized is said tubular members being of woven textile material.

3. The combination in accordance with claim 1, further characterized in said tubular members being of knitted textile material.

* * * * *